US007009131B2

(12) United States Patent
Diep

(10) Patent No.: US 7,009,131 B2
(45) Date of Patent: Mar. 7, 2006

(54) SWITCH ASSEMBLY

(75) Inventor: Chuong Diep, Corono, CA (US)

(73) Assignee: Eaton Corporation, Cleveland, OH (US)

( * ) Notice: Subject to any disclaimer, the term of this patent is extended or adjusted under 35 U.S.C. 154(b) by 7 days.

(21) Appl. No.: 10/623,409

(22) Filed: Jul. 18, 2003

(65) Prior Publication Data

US 2005/0011741 A1 Jan. 20, 2005

(51) Int. Cl.
*H01H 13/00* (2006.01)

(52) U.S. Cl. ..... 200/523; 200/524; 200/417; 200/341

(58) Field of Classification Search ..... 200/523, 200/524, 529, 5 A, 16 A–16 F, 16, 405, 408, 200/41, 417, 449, 462, 465–468, 308, 329, 200/310–317, 16 R, 341, 533, 542, 545–558
See application file for complete search history.

(56) References Cited

U.S. PATENT DOCUMENTS 3,315,535 A 4/1967 Stevens
3,651,700 A * 3/1972 Bailey ..... 74/107
4,001,526 A * 1/1977 Olson ..... 200/16 D
4,332,990 A 6/1982 Stevens
5,659,162 A 8/1997 Hart
6,153,841 A 11/2000 Hart
6,667,451 B1 * 12/2003 Hart ..... 200/314

OTHER PUBLICATIONS

"Series 584-Four Pole Lighted Pushbutton Switches", by Eaton Corporation, Aerospace Controls Division, Costa Mesa, California, Copyright © 1994.

* cited by examiner

*Primary Examiner*—Lincoln Donovan
*Assistant Examiner*—M. Fishman
(74) *Attorney, Agent, or Firm*—Tarolli, Sundheim, Covell & Tummino L.L.P.

(57) ABSTRACT

A switch assembly includes switch contacts, a snap action type switch actuation mechanism, a cam block having a cam surface which is engaged by cam follower, and a manually movable push button. Upper and lower force transmitting pins extend in opposite directions from the cam block to a push button and the snap action mechanism. The cam block and force transmitting pins are integrally formed as one piece. The upper force transmitting pin is connected with the push button by a snap connection. The switch actuation mechanism includes upper and lower actuator members each of which has a main section and a pair of bearing sections. The main sections and bearing sections of each of the actuator members are integrally formed as one piece.

13 Claims, 7 Drawing Sheets

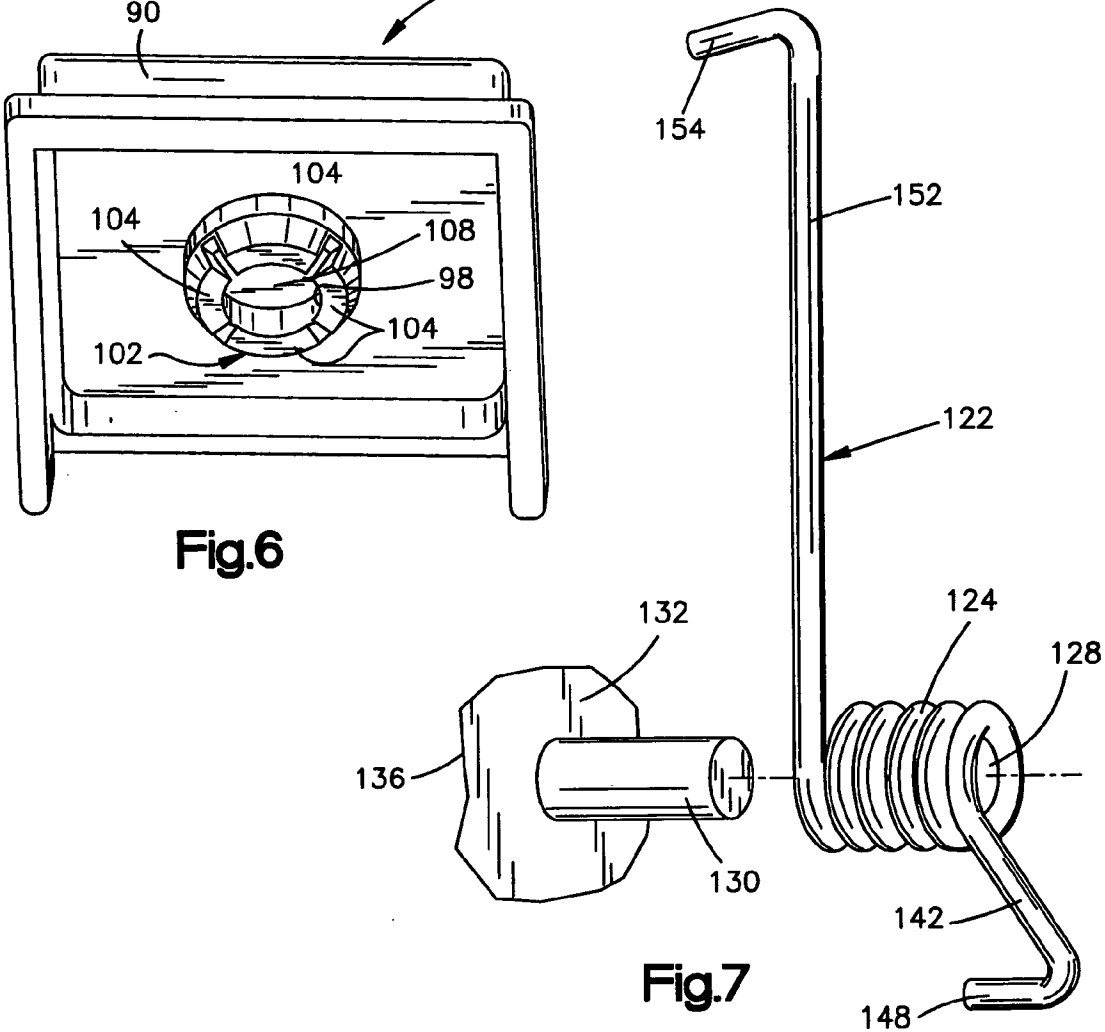
Fig.7
Fig.6
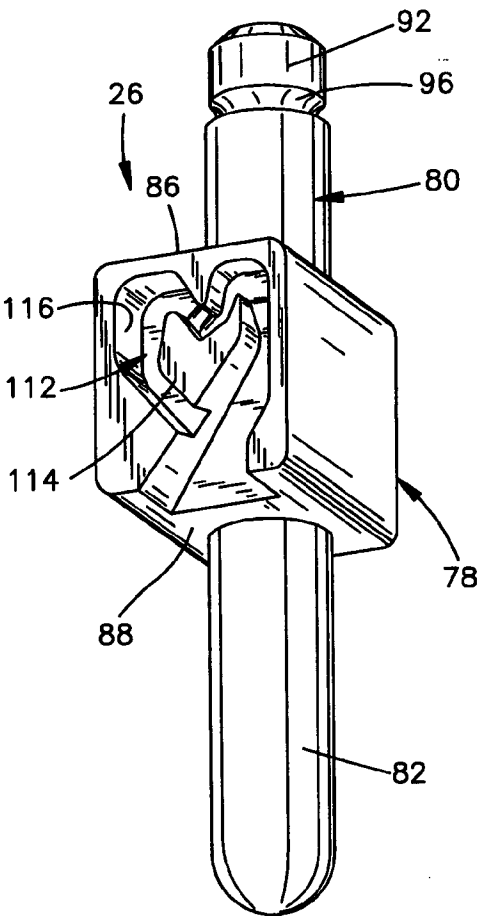
Fig.5

SWITCH ASSEMBLY

BACKGROUND OF THE INVENTION

The present invention relates to a new and improved switch assembly.

Known switch assemblies include switch contacts which are disposed in a housing and are operable between actuated and unactuated conditions. A snap action mechanism is also disposed in the housing and is connected with the switch contacts. The snap action mechanism is operable to effect operation of the switch contacts between actuated and unactuated conditions. A force transmitting apparatus extends between a push button and the snap action mechanism.

A switch assembly having such a construction is disclosed in U.S. Pat. No. 3,315,535. Another switch assembly having this general construction is commercially available from Eaton Corporation of Costa Mesa, Calif. under the designation Series 584-Four Pole Lighted Pushbutton Switches.

These known switch assemblies are satisfactory in their mode of operation. However, it is desirable to reduce the number of components in a switch assembly to increase operational reliability. By reducing the number of components, build up tolerances is reduced. In addition, wear of tooling required to make the different components is reduced. It is also desirable to reduce the weight of a switch assembly.

SUMMARY OF THE INVENTION

An improved switch assembly is relatively light in weight and has relatively few component parts. The switch assembly may include switch contacts which are at least partially disposed in a housing and are operable between actuated and unactuated conditions. A switch actuation mechanism may be disposed in the housing. A force transmitting apparatus may extend between a push button and the switch actuation mechanism to transmit force from the push button to the switch actuation mechanism. The switch actuation mechanism may be of the snap action type.

The force transmitting apparatus may include a cam block. First and second force transmitting pins may be integrally formed as one piece with the cam block. A cam follower may engage a cam surface on the cam block to retain the switch contacts in an actuated condition.

By forming the cam block and force transmitting pins as one piece, the operational reliability of the improved switch assembly is increased and the cost is decreased. A build up of tolerances between separate force transmitting pins and the cam block is avoided. In addition, an increase in tolerances due to a wear of tooling used to form force transmitting pins separately from the cam block is avoided.

The switch actuation mechanism may include a plurality of actuator members. Each of the actuator members may include a main section and a plurality of bearing sections. The main section and bearing sections of each actuator member may be integrally formed as one piece.

By forming the main section and bearing sections of the actuator members in the switch actuation mechanism as one piece, the operational reliability of the improved switch assembly is increased and the cost is decreased. A build up of tolerances between separate main and bearing section is avoided. In addition, an increase in tolerances due to wear of tooling used to form the main sections separately from the bearing sections is avoided. If desired, the switch actuation mechanism may be a snap action mechanism. However, other types of switch actuation mechanisms may be used if desired.

The push button may have an opening into which an end portion of one of the force transmitting pins extends. A resiliently deflectable flange may engage the end portion of the force transmitting pin. The flange on the push button interconnects the push button and the force transmitting pin so that the force transmitting pin can snap into the opening in the push button.

By forming the push button separately from the force transmitting pin, any one of a plurality different push buttons may be snapped onto the force transmitting pin. This enables postponement of a decision as to which push button is to be used with a particular switch assembly. Therefore, a switch assembly can be easily customized shortly before it is to be supplied to a user of the switch assembly.

The push button may advantageously be connected with the switch contacts by a printed circuit. Electrical circuit components may be mounted on the printed circuit. The printed circuit may have an opening through which a force transmitting pin extends from the cam block to the push button.

Since electrical circuit components are mounted on the printed circuit, any one of a plurality of different electrical circuit components may be mounted on the printed circuit. This enables postponement of a decision as to which electrical circuit components are to be used with a particular switch assembly. Therefore, the switch assembly can be easily customized shortly before it is to be supplied to a user of the switch assembly.

The present invention has a plurality of different features. These features may advantageously be utilized in combination with each other in the manner disclosed herein. Alternatively, the features may be utilized separately and/or in combination with known features from the prior art.

BRIEF DESCRIPTION OF THE DRAWINGS

The foregoing and other features of the present invention will become more apparent upon a consideration of the following description taken in connection with the accompanying drawings wherein:

FIG. 5. is an enlarged pictorial illustration depicting the construction of a force transmitting apparatus which includes a cam block and upper and lower force transmitting pins which are integrally formed as one piece with the cam block;

FIG. 6. is an enlarged pictorial illustration of a portion of a push button of the switch assembly of FIG. 1;

FIG. 7. is a simplified fragmentary schematic illustration depicting the manner in which a cam follower is mounted on a housing in the switch assembly of FIGS. 1–4;

DESCRIPTION OF SPECIFIC PREFERRED EMBODIMENTS OF THE INVENTION

Switch Assembly

Figure 1:
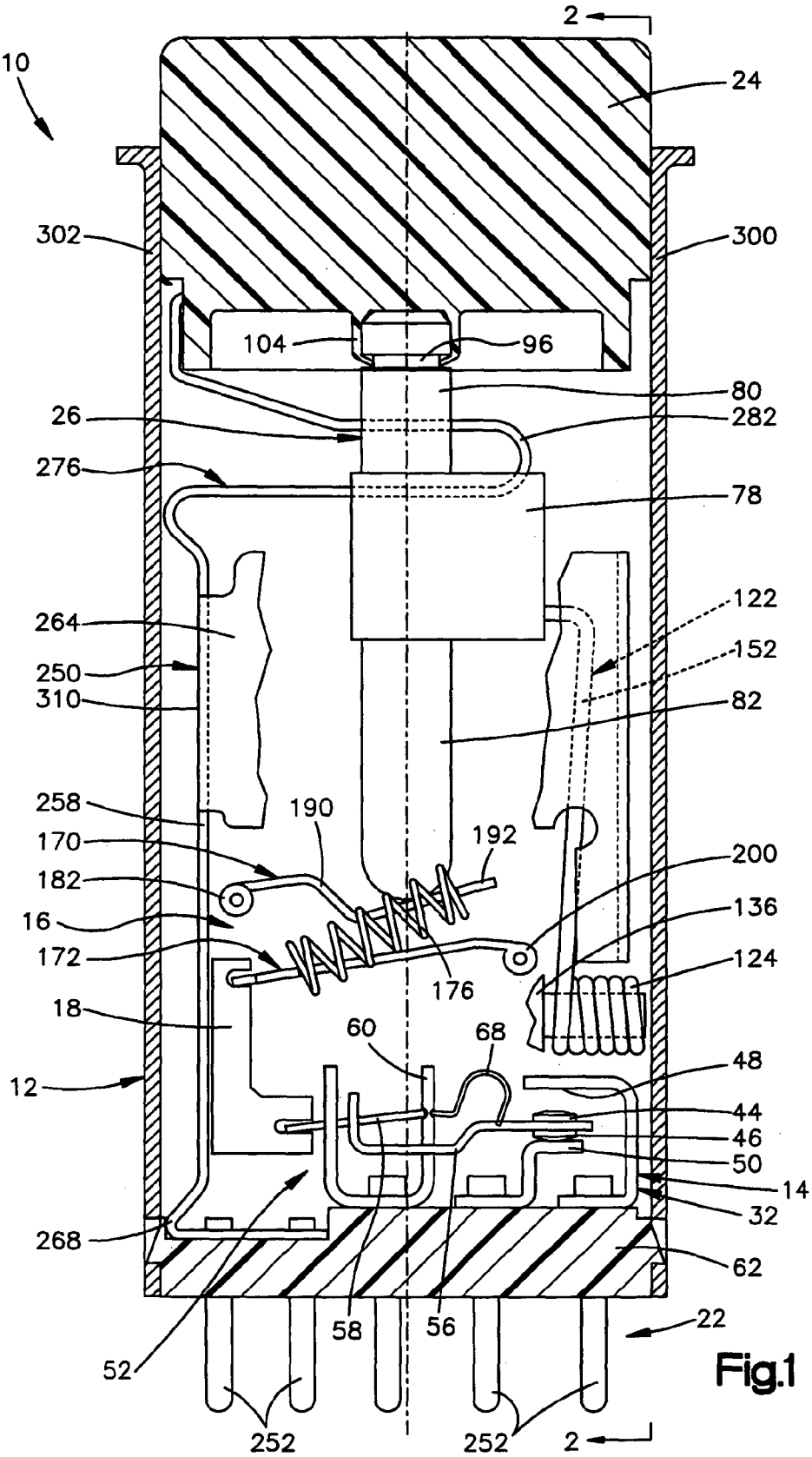
FIG. 1. is a simplified broken away schematic sectional view of a switch assembly constructed in accordance with the present invention, the switch assembly being illustrated in an unactuated condition.
Figure 2:
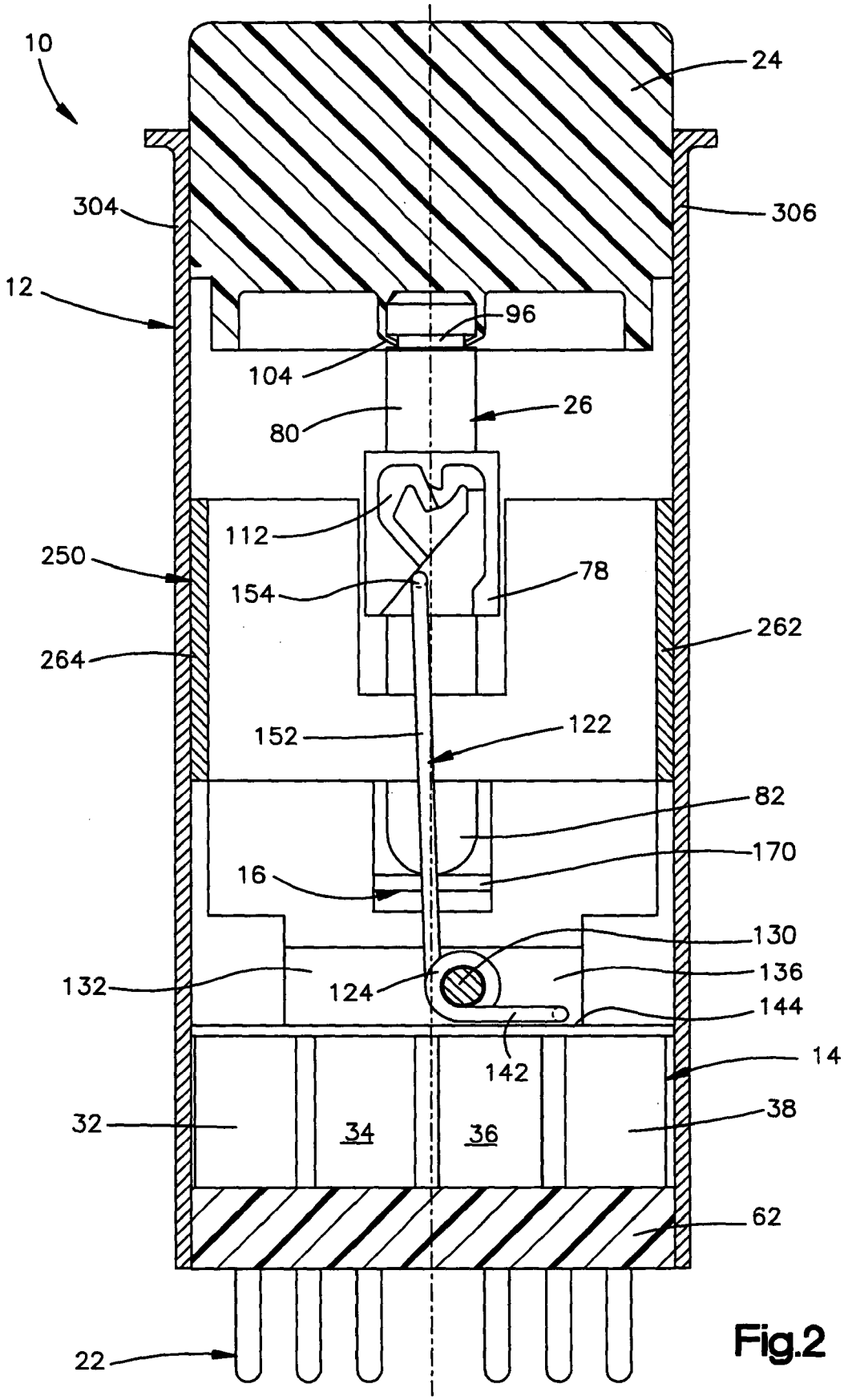
FIG. 2. is a simplified schematic sectional view, taken generally along the line 2—2 of FIG. 1, further illustrating the construction of the switch assembly.

A switch assembly 10 constructed in accordance with the present invention is illustrated schematically in FIGS. 1 and 2 in an unactuated condition. The switch assembly 10 includes a housing 12. An array 14 of switch contacts is disposed adjacent to the lower end portion of the housing 12.

Figure 4:
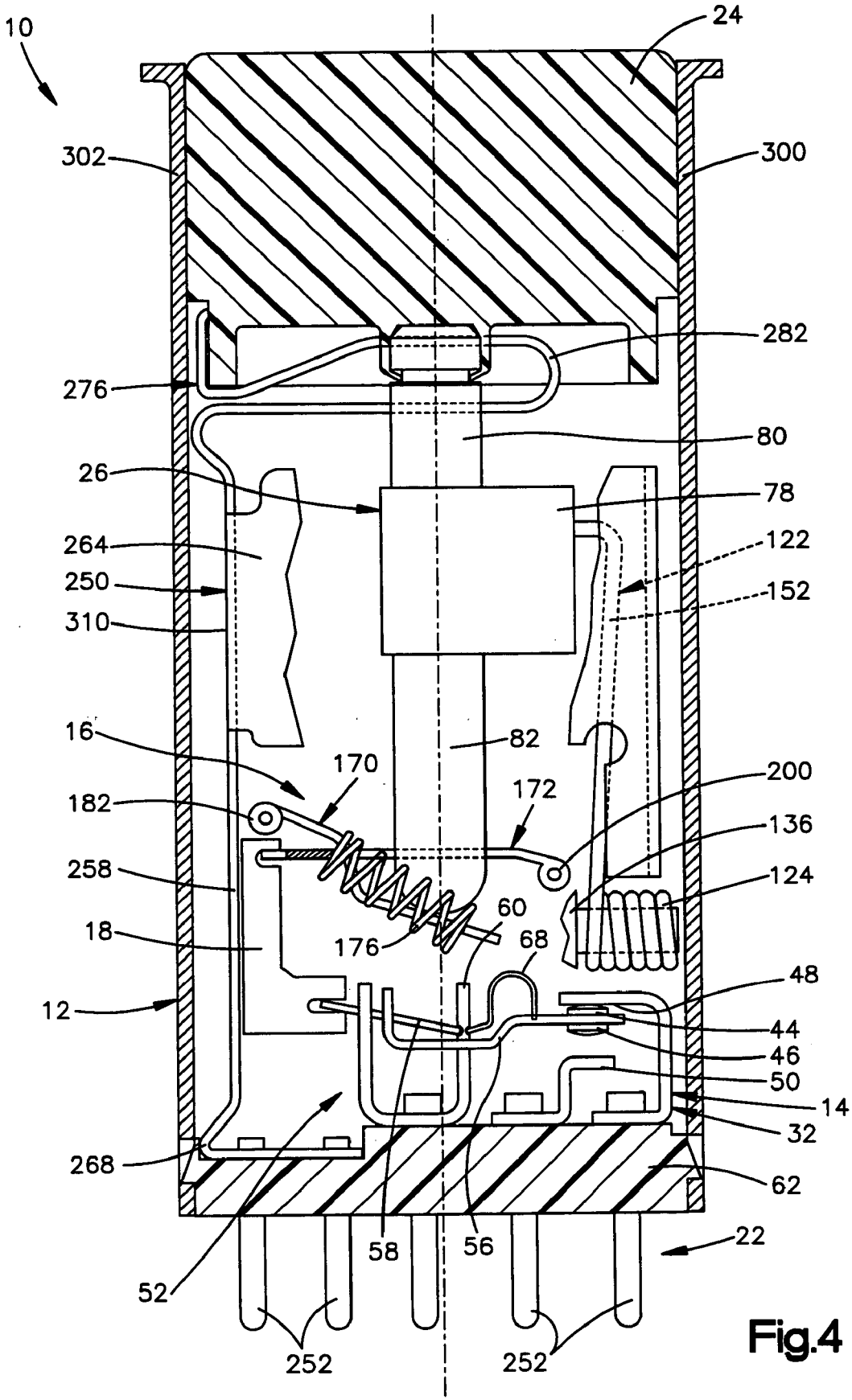
FIG. 4. is a simplified fragmentary schematic sectional view, generally similar to a portion of FIG. 1, illustrating the switch assembly in the actuated condition.

A switch actuation mechanism 16 is connected with the array 14 of switch contacts by a generally L-shaped connector member 18 (FIG. 1). The switch actuation mechanism 16 is operable between a first condition (FIG. 1) and a second condition (FIG. 4) to effect operation of an array of switch contacts 14 between an unactuated condition (FIG. 1) and an actuated condition (FIG. 4). The array 14 of switch contacts is connected with an array 22 of switch terminals. The switch actuation mechanism 16 is of the snap action type. However, the types of actuation mechanisms may be utilized if desired.

When a push button 24 is manually depressed (FIG. 3), a force transmitting apparatus 26 is effective to transmit force to the snap action type switch actuation mechanism 16 (FIGS. 1, 2, and 4). The force transmitted from the push button 24 through the force transmitting apparatus 26 causes the switch actuation mechanism 16 to operate the contacts from the unactuated condition of FIG. 1 to the actuated condition of FIG. 4 with a snap action. When the switch actuation mechanism 16 is released by the force transmitting apparatus 26, the switch actuation mechanism is effective to operate the switch contacts from the actuated condition of FIG. 4 back to the unactuated condition of FIG. 1 with a snap action.

The push button 24 contains light sources which are energizable to illuminate indicia in the same manner as in the Series 584-Four Pole Lighted Pushbutton Switch which is commercially available from Eaton Corporation of Costa Mesa, Calif. Of course, the push button 24 may have a different construction if desired.

It is contemplated that any one of a plurality of push buttons 24 having different arrangements of light sources and different indicia may be used with the switch assembly 10. The selection of a particular arrangement of light sources and a particular indicia for the push button 24 may be postponed until shortly before the switch assembly 10 is to be supplied to a user of the switch assembly. This facilitates customizing the switch assembly 10 to suit the needs of the user to which the switch assembly is to be supplied.

Although it is preferred to use a snap action type mechanism for the switch actuation mechanism 16, a different type of mechanism may be used if desired. For example, the actuation mechanism 16 may maintain the switch contacts actuated only while the push button 24 is depressed.

Switch Contacts

The array 14 of switches includes identical sets 32, 34, 36 and 38 (FIG. 2) of switch contacts. The set 32 (FIGS. 1 and 4) of switch contacts includes an upper movable switch contact 44 and a lower movable switch contact 46. The upper movable switch contact 44 is engagable with an upper stationary switch contact 48. The lower movable switch contact 44 is engagable with a lower stationary switch contact 50.

An actuator lever system 52 is connected with the movable switch contacts 44 and 46. The actuator lever system 52 effects operation of the set 32 of switch contacts between the unactuated condition (FIG. 1) and the actuated condition (FIG. 4) with a snap action. The actuator lever system 52 is connected with the switch actuation mechanism 16 by the L-shaped connector member 18.

The actuator lever system 52 includes a contact support lever 56 on which the upper and lower movable switch contacts 44 and 46 are disposed. An actuator lever 58 has an end portion which is engaged by the L-shaped connector member 18. The opposite end portion of the actuator lever 58 engages an upstanding post 60 which is fixedly secured to a base 62 of the switch assembly 10. An actuator lever spring 68 extends between the post 60 and the contact support lever 56.

Upon manual actuation of the push button 24, force is transmitted through the force transmitting apparatus 26 to the switch actuation mechanism 16. The illustrated switch actuation mechanism 16 is of the snap action type and quickly raises the L-shaped connector member 18, with a snap action, to operate the actuator lever system 52. Operation of the actuator lever system 52 quickly moves the movable switch contacts 44 and 46 away from the lower stationary switch contact 50 toward the upper stationary switch contact 48 with a snap action. This results in the set 32 of switch contacts being quickly operated from the unactuated condition of FIG. 1 to the actuated condition of FIG. 4 with a snap action. When the set 32 of switch contacts has been operated from the unactuated condition of FIG. 1 to the actuated condition of FIG. 4, the L-shaped connector member 18 is held in the raised position by the snap action type switch actuation mechanism 16.

When the array 14 of switch contacts is operated from the unactuated condition illustrated in FIG. 1 to the actuated condition illustrated in FIG. 4, the snap action type switch actuation mechanism 16 quickly moves the L-shaped lever 18 upward from the unactuated condition illustrated in FIG. 1 to the actuated condition illustrated in FIG. 4. As this occurs, the actuator lever 58 is pivoted in a clockwise direction (as viewed in FIGS. 1 and 4) about its line of engagement with the post 60. This moves the left (as viewed in FIG. 1) end portion of the contact support lever 56 upward toward the position shown in FIG. 4.

As the contact support lever 56 is pivoted in a clockwise direction (as viewed in FIG. 1) by the L-shaped connector member 18, force applied by the actuator spring 68 to the contact support lever 56 decreases as opposite end portions of the actuator spring 68 move into alignment with each other. Once opposite end portions of the actuator spring 68 have been moved into alignment with each other, the next increment of upward movement of the left (as viewed in FIG. 1) end portion of the contact support lever 56 results in the actuator lever spring 68 being moved to an overcenter condition. As this occurs, the actuator lever spring 68 urges the contact lever 56 to pivot, in a counter clockwise direction, about the location where it engages the actuator lever 58. As the contact lever 56 pivots, the actuator lever spring 68 is effective to move the upper movable switch contact 44 into engagement with the upper stationary switch contact 48 with a snap action. At the same time, the contact support lever 56 moves to the position illustrated in FIG. 4. This results in the set 32 of switch contacts being quickly operated from the unactuated condition of FIG. 1 to the actuated condition of FIG. 4 by the actuator lever system 52.

The actuator lever system 52 also effects operation of the set 32 of switch contacts from the actuated condition (FIG. 4) to the unactuated condition (FIG. 1) with a snap action. When this is to happen, the switch actuation mechanism 16 quickly moves the L-shaped connector member 18 downward from the actuated condition illustrated in FIG. 4 to the unactuated condition illustrated in FIG. 1. As this occurs, the actuator lever 58 is pivoted in a counter clockwise direction (as viewed in FIG. 4) relative to the post 60. This moves the left end of the contact support lever 56 downward toward the position shown in FIG. 1. This pivots the contact support lever 56 in a counter clockwise direction about the upper movable switch contact 44.

As the contact support lever 56 is pivoted in a counter clockwise direction (as viewed in FIG. 4), force applied by the actuator lever spring 68 to the contact support lever decreases. Once opposite end portions of the actuator lever spring 68 have been moved into alignment with each other, the next increment of downward movement of the L-shaped connector member 18 moves the actuator lever spring 68 to an overcenter condition. As this occurs, the actuator lever spring 68 pivots the contact support lever 56 about the location where it engages the actuator lever 58. The actuator lever spring 68 pivots the contact lever 56 to move the upper movable switch contact 44 out of engagement with the upper stationary switch contact 48. Immediately thereafter, the lower movable switch contact 46 moves into engagement with the lower stationary switch contact 50 with a snap action.

Although only a single set 32 of switch contacts is illustrated in FIG. 1, it should be understood that sets 34, 36 and 38 (FIG. 2) of switch contacts all have the same construction and mode of operation. The lower (as viewed in FIGS. 1 and 4) end portion of the L-shaped connector member 18 is long enough to engage the actuator lever 58 in each of the sets 34, 36 and 38 of switch contacts.

The general construction and mode of operation of the array 14 of switch contacts is well known and is the same as in Series 584-Four Pole Lighted Pushbutton Switches which are commercially available from Eaton Corporation of Costa Mesa, Calif. The general construction and mode of operation of the array 14 of switch contacts is the same as is disclosed in U.S. Pat. Nos. 5,659,162 and 6,153,841. The disclosures in the aforementioned U.S. Pat. Nos. 5,659,162 and 6,153,841 are hereby incorporated herein in their entirety by this reference thereto.

It should be understood that the array of switch contacts 14 may have a construction which is different than the specific construction disclosed herein. Thus, it is contemplated that any one of many different known switch constructions may be substituted for the specific switch construction illustrated in FIGS. 1 and 4 and previously described herein. The disclosed construction of the sets 32, 34, 36 and 38 of switch contacts should be considered as merely being exemplary and it is not intended to limit the invention to any one specific construction for the sets of switch contacts.

Force Transmitting Apparatus

The force transmitting apparatus 26 (FIGS. 1–5) is effective to transmit force from the push button 24 (FIG. 1) to the switch actuation mechanism 16. The force transmitted from the push button 24 through the force transmitting apparatus 26 is effective to cause the switch actuation mechanism 16 to quickly move the L-shaped connector member 18 from the unactuated condition of FIG. 1 to the actuated condition of FIG. 4 with a snap action. This causes rapid operation of the array 14 of switch contacts from the unactuated condition to the actuated condition.

The force transmitting apparatus 26 (FIG. 5) includes a cam block 78, an upper force transmitting pin 80 extends upward from the cam block 78. The upper force transmitting pin 80 is connected with the push button 24. In addition to the cam block 78 and upper force transmitting pin 80, the force transmitting apparatus 26 includes a lower force transmitting pin 82. The lower force transmitting pin transmits force from the cam block 78 to the snap action type switch actuation mechanism 16 (FIG. 1). It should be understood that known switch actuation mechanisms of a type other than the snap action type may be substituted for the snap action mechanism.

The upper force transmitting pin 80 (FIG. 5) has a cylindrical configuration. Similarly, the lower force transmitting pin 82 has a cylindrical configuration. The upper and lower force transmitting pins 80 and 82 are disposed in a coaxial relationship. The coincident central axes of the upper and lower force transmitting pins 80 and 82 extends through the center of the cam block 78 and extends perpendicular to flat parallel upper and lower side surfaces 86 and 88 of the rectangular cam block 78.

In order to minimize the number of components and the weight of the switch assembly 10, the force transmitting apparatus 26 is integrally formed as one piece of polymeric material. It is contemplated that the force transmitting apparatus 26 may be formed by molding polymeric material to the configuration corresponding to the configuration of the cam block 78, upper force transmitting pin 80 and lower force transmitting pin 82. Alternatively, the force transmitting apparatus 26 may be cut from a single block of polymeric material.

By forming the cam block 78 and force transmitting pins 80 and 82 as one piece, the operational reliability of the switch assembly 10 is increased and the cost of the switch assembly is decreased. A build up of tolerances between the force transmitting pins 80 and 82 and the cam block is avoided. An increase in tolerances due to wear of tooling used to form the force transmitting pins 80 and 82 and the cam block 78 is avoided. In addition, installation of the force transmitting pins 80 and 82 and cam block 78 in the switch assembly 10 during construction of the switch assembly is facilitated by integrally forming the force transmitting pins 80 and 82 and the cam block 78 as one piece.

The upper force transmitting pin 80 has an upper end portion 92 (FIG. 5) which is connected with a bottom wall 90 of the push button 24 (FIG. 6). In order to facilitate connection of the upper end portion 92 of the upper force transmitting in 80 with a push button 24, a snap connection is provided to interconnect the push button and upper force transmitting pin. The snap connection is formed between an annular groove 96 (FIG. 5) in the upper end portion 92 of the upper force transmitting pin 80 and an opening 98 disposed on a lower side of the push button 24 (FIG. 6). The opening 98 on the lower side of the push button 24 is formed by an annular array 102 of flanges 104.

When the force transmitting apparatus 26 and push button 24 are to be interconnected, the push button is aligned with the upper force transmitting pin 80. Force is then applied against the push button 24 to press the flanges 104 (FIG. 6) against the upper end portion 92 of the upper force transmitting pin 80 (FIG. 5). The rounded upper end portion 92 of the force transmitting pin 80 is effective to resiliently to deflect the flanges 104 radially outward away from each other to increase the size of the opening 98. As this occurs, the upper end portion 92 of the upper force transmitting pin 80 moves through the opening 98 into a general cylindrical recess 108 formed in the bottom wall 90 of the push button 24.

As the upper end portion 92 of the upper force transmitting pin 80 moves through the opening 98 into the recess 108, the flanges 104 move into radial alignment with the annular groove 96 in the upper end portion of the upper force transmitting pin. As this occurs, the flanges 104 resiliently move back toward their undeflected positions and move into the annular groove 96. The flanges 104 move into the annular groove 96 with a snap action under the influence of the resilience of the flanges.

In the illustrated embodiment of the invention, the snap connection between the push button 24 and the force transmitting apparatus 26 is formed by resiliently deflectable flanges 104 which are integrally molded as one piece with the bottom wall 90 of the push button 24. However, it is contemplated that the snap connection between the push button 24 and the force transmitting apparatus 26 may be formed in a different manner. For example, rather than having an annular groove 96 in the upper end portion 92 of the upper force transmitting pin 80, an annular flange may be provided on the upper end portion 92 of the upper force transmitting pin 80.

If desired, the push button 24 may be provided with a resilient member or members which are not integrally formed as one piece with the push button 24 in the same manner as are the flanges 104. For example, a metal spring may be utilized to interconnect the push button 24 and the force transmitting apparatus 26. However, it is believed that it would be preferred to minimize the number of components of the switch assembly 10 by forming the components of the snap connection between the force transmitting apparatus 26 and the push button 24 as one piece with the force transmitting apparatus and push button.

By forming the push button 24 separately from the force transmitting pin 80, any one of several different push buttons may be snapped onto the force transmitting pin. This enables postponement of a decision as to which push button 24 is to be used with a particular switch assembly 10. Therefore, the switch assembly 10 can be easily customized by selection of a push button 24 having desired indicia and/or arrangement of light sources until shortly before the switch assembly is to be supplied to a user of the switch assembly.

A cam track 112 (FIG. 5) is formed in the cam block 78. The cam track 112 has a generally heart shaped configuration and includes an inner cam surface 114 and an outer cam surface 116. The cam surfaces 114 and 116 are integrally formed as one piece with the cam block 78. It is contemplated that the cam track 112 may be molded into the single piece of polymeric material forming the cam block 78 or may be cut into the cam block after the cam block has been formed.

The cam track 112 may have a configuration which is different than the illustrated heart shaped configuration. For example, the cam track 112 may have a configuration corresponding to the configuration illustrated in U.S. Pat. No. 3,315,535 or the configuration illustrated in U.S. Pat. No. 4,332,990. it should be understood that the cam track 112 may have any desired configuration.

The cam track 112 is engaged by a cam follower 122 (FIGS. 1–3 and 7). The cam follower 122 is integrally formed as one piece and includes a helical main section 124 (FIGS. 1, 2, and 7). The helical main section 124 has a cylindrical central passage 128 (FIG. 7) into which a cylindrical support pin 130 extends. The support pin 130 is integrally formed as one piece with a side wall 132 (FIGS. 2 and 7) of an inner casing or housing 136.

The inner housing 136 is integrally formed as one piece of suitable polymeric material and is enclosed by the outer housing 12. The outer housing 12 is formed of metal. However, the outer housing 12 may be formed of a different material if desired.

The cylindrical support pin 130 (FIG. 7) extends through the cylindrical opening 128 in the helical main section 124 of the cam follower 122. A base arm 142 extends from the helical main section 124 and rests against a side surface 144 (FIG. 2) on the inner housing 136. The base arm 142 has an end section 148 (FIG. 7) which extends parallel to a longitudinal central axis of the helical main section 124.

In addition, the cam follower 122 includes a follower arm 152 (FIGS. 1, 2 and 7). The follower arm 152 has an end section 154 (FIG. 7) which engages the cam track 112 in the manner illustrated in FIGS. 2 and 3. The end section 154 (FIG. 7) of the follower arm 152 extends parallel to the end section 148 of the base arm 142. Both the end section 154 of the follower arm 152 and the end section 148 of the base arm 142 extend in the same direction, that is, toward the left (as viewed in FIG. 7). The end sections 148 and 154 of the base arm 142 and follower arm 152 both extend parallel a central axis of the helical main section 124. When the cam follower is mounted in the switch assembly (FIGS. 1 and 2), the central axis of the helical main section 124 is coincident with the central axis of the support pin 130.

The cam follower 122 is formed as a torsion spring from one piece of wire. Thus, a suitable metal spring wire is bent to form the main section 124, base arm 142 and follower arm 152. As initially formed, the base arm 142 and follower arm 152 are angularly offset from each other by an angle which is greater than when the cam follower 122 is mounted in the switch assembly (FIG. 2).

After the helical main section 124 of the cam follower 122 has been positioned on the support pin 130 and the base arm 142 positioned in engagement with the side surface 144 (FIG. 2) of the inner housing 136, the follower arm 152 is resiliently deflected in a clockwise direction (as viewed in FIG. 2) to move the end section 154 of the follower arm into engagement with the cam track 112. The end section 154 of the resiliently deflected follower arm 152 is pressed against surfaces of the cam track by the resilience of the cam follower 122. This results in the end section 154 of the follower arm 152 being pressed against the inner cam surface 114 or the outer cam surface 116 of the cam track 112.

The switch assembly 10 is of the alternate action type. Therefore, when the switch assembly 10 is in the initial or unactuated conditions of FIGS. 1 and 2, the array 14 of switch contacts are in an unactuated condition. When the push button 24 is manually depressed, the force transmitting apparatus 26 and push button are moved downward from the position illustrated in FIG. 2 to the position illustrated in FIG. 3. As this occurs, the switch actuation mechanism 16 effects operation of the array 14 of switch contacts to their engaged conditions with a snap action.

Figure 3:
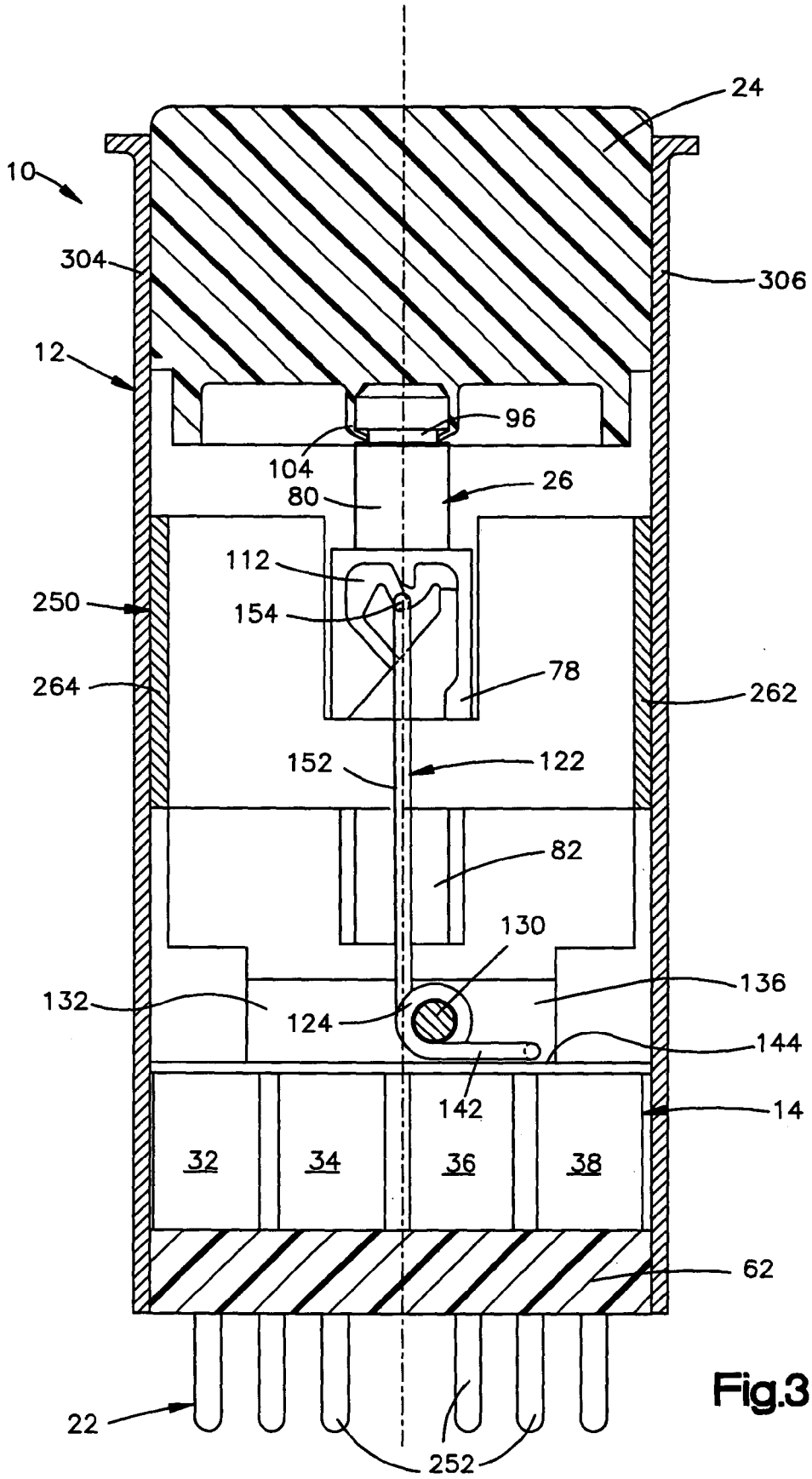
FIG. 3. is a simplified schematic sectional view, generally similar to FIG. 2, illustrating the switch assembly in an actuated condition.

The cam follower 122 cooperates with the cam track 112 to hold the force transmitting apparatus 26 and the push button 24 in the actuated condition illustrated in FIG. 3. At this time, the end section 154 on the follower arm 152 of the cam follower 122 (FIG. 7) engages a cusp in the inner cam surface 114 (FIGS. 3 and 5) to hold the force transmitting apparatus 26 and push button 24 in their actuated positions.

When the push button 24 is again manually depressed, the end section 154 of the follower arm 152 moves out of engagement with the cusp in the inner cam surface 114. This releases the force transmitting apparatus 26 and push button 24 upward (as viewed in FIG. 3) movement under the influence of force applied against the force transmitting apparatus 26 by the snap action type switch actuation mechanism 16. This force moves the push button and force transmitting apparatus 26 back to the unactuated condition illustrated in FIG. 2. When the switch assembly cam returns to the unactuated condition of FIG. 2, the array 14 of switch contacts return to their unactuated condition (FIG. 1). At this time, the end section 154 of the follower arm 152 is in engagement with a lower portion of the cam track 112.

It is contemplated that it may be desired to convert the switch assembly 10 from an alternate action type switch assembly to a momentary action type switch assembly. If the switch assembly 10 is to be converted to a momentary action type switch assembly, it is merely necessary to remove the cam follower 122 from the switch assembly. To remove the cam follower 122 from the switch assembly, the helical main section 124 of the cam follower is pulled off of the support pin 130 (FIG. 7). This disengages the cam follower 122 from the switch assembly 10.

Once the cam follower 122 has been disengaged from the switch assembly 10, there is nothing to retain the switch assembly in its actuated condition. Therefore, when the push button 24 is depressed, the array 14 of switch contacts remains in its actuated condition as long as the push button 24 is held in a depressed condition. When the push button is released, the snap action type switch actuation mechanism 16 applies force to the force transmitting apparatus 26 to move the push button 24 back to the unactuated position of FIGS. 1 and 2. At the same time, the snap action type switch actuation mechanism 16 moves the L-shaped connector member 18 downward to operate the array 14 of switch contacts from the actuated condition of FIG. 4 back to the unactuated condition of FIG. 1.

Switch Actuation Mechanism

The snap action type switch actuation mechanism 16 effects rapid operation of the switch contacts 14 between the actuated and unactuated conditions of FIGS. 1 and 4. In addition, the snap action type switch actuation mechanism 16 applies force to the force transmitting apparatus 26 to move the force transmitting apparatus and push button 24 from their actuated positions (FIGS. 3 and 4) back to their unactuated positions. Although the switch actuation mechanism 16 is of the snap action type and may be referred to as a snap action mechanism, the switch actuation mechanism may have any one of many known constructions which are not snap action mechanisms.

The snap action type switch actuation mechanism 16 includes an upper actuator member 170 (FIGS. 1, 4, and 8) and a lower actuator member 172. The upper actuator member 170 is engaged by the lower force transmitting pin 82 of the force transmitting apparatus 26 (FIGS. 1 and 4). The lower actuator member 172 is connected with the L-shaped connector member 18.

A plurality of helical coil biasing springs 176 extend between the upper and lower actuator members 170 and 172. Although only a single helical coil biasing spring 176 is illustrated in FIGS. 1 and 4, it should be understood that there are a plurality of helical coil biasing springs. However, if desired, only a single helical coil biasing spring may be utilized.

The upper actuator member 170 (FIG. 8) includes a pair of cylindrical bearing sections 182 and 184. The bearing sections 182 and 184 are disposed in a coaxial relationship and have the same size and configuration. A generally T-shaped main section 188 is formed as one piece with the bearing sections 182 and 184. The bearing sections 182 and 184 extend in opposite directions from the main section 188.

The main section 188 includes a body portion 190 having a central axis which extends perpendicular to the coincident central axes of the bearing sections 182 and 184. In addition, the main section 188 includes a cross portion 192 having a central axis which extends perpendicular to the central axis of the body portion and parallel to the coincident central axes of the bearing sections 182 and 184. The main section 188 and bearing sections 182 and 184 are integrally formed by one piece of light weight polymeric material.

By forming the main section 188 and bearing sections 182 and 184 of the snap action type switch actuation mechanism 16 as one piece, the operational reliability of the switch assembly 10 is increased and the cost of the switch assembly is decreased. A build up of tolerances between the main section 188 and bearing sections 182 and 184 is avoided. In addition, installation of the main section 188 and bearing sections 182 and 184 in the switch assembly 10 during construction of the switch assembly is facilitated by forming the main section and bearing sections as one piece.

The lower actuator member 172 includes a pair of cylindrical bearing sections 200 and 202. The cylindrical bearing sections 200 and 202 are disposed at opposite ends of a cylindrical intermediate section 204. The bearing sections 200 and 202 and intermediate section 204 have coincident central axes which extend parallel to the coincident central axes of the bearing sections 182 and 184 of the upper actuator member 170.

In addition, to the bearing sections 200 and 202, the lower actuator member 172 includes a main section 208. The main section 208 of the lower actuator member 172 is formed as one piece with bearing sections 200 and 202 and has a generally U-shaped configuration. The main section 208 and bearing sections 200 and 202 are integrally formed by one piece of light weight polymeric material.

The main section 208 includes a pair of parallel arms 210 and 212. A connector section 214 extends between the arms 210 and 212. The connector section 214 extends parallel to the intermediate section 204 and perpendicular to the arms 210 and 212 of the lower actuator member 172.

The main section 208 of the lower actuator member 172 defines a general rectangular opening 218. The arms 210 and 212 are spaced apart by a distance which is greater than the length of the cross section 192 on the upper actuator member 170. Therefore, the main section 188 on the upper actuator member 170 can move through the opening 218 formed by the main section 208 of the lower actuator member 172.

By forming the main section 208 and bearing sections 200 and 202 of the snap action type switch actuation mechanism 16 as one piece, the operational reliability of the switch assembly 10 is increased and the cost of the switch assembly is decreased. A build up of tolerances between the main section 208 and bearing sections 200 and 202 is avoided. In addition, installation of the main section 208 and bearing sections 200 and 202 in the switch assembly 10 during construction of the switch assembly is facilitated by forming the main section and bearing sections as one piece.

Figure 8:
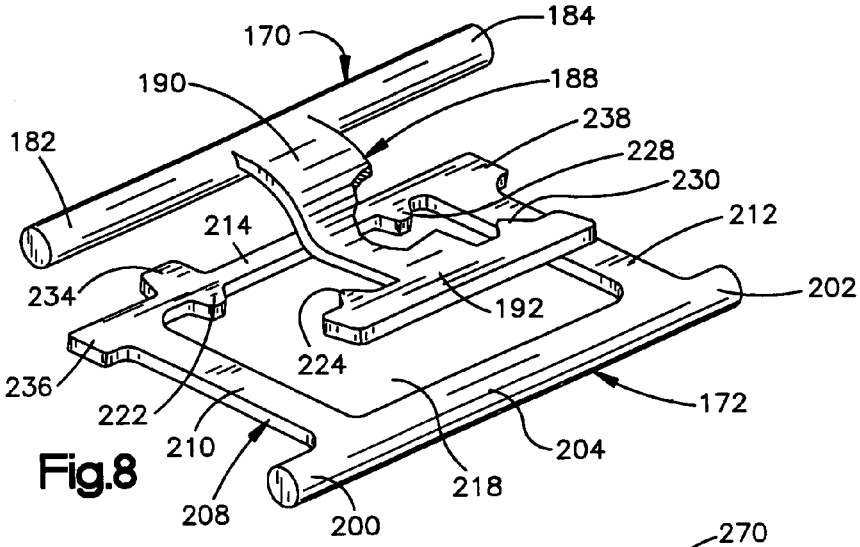
FIG. 8. is an enlarged pictorial illustration of actuator members utilized in a switch actuation mechanism in the switch assembly of FIGS. 1–4.

The spring 176 (FIGS. 1 and 3) extends between the upper actuator member 170 and the lower actuator member 172. One end of the spring 176, that is, the lower left end, as viewed in FIG. 1, engages a projection 222 (FIG. 8) from the cross section 214 of the main section 208 of the lower actuator member 172. The upper right, as viewed in FIG. 1, end of the spring 176 engages a projection 224 on the cross section 192 of the main section 188 of the upper actuator member 170 (FIG. 8). Similarly, a second spring (not shown) extends between a projection 228 on the connector section 214 of the lower actuator member 172 and a projection 230 on the cross section 192 of the upper actuator member 170.

In addition to the projections 222 and 228 for connection with biasing springs corresponding to the biasing spring 176, the connector section 214 of the lower actuator member 172 is provided with a projection or arm 234. The arm 234 is engaged by the L-shaped connector member 18 (FIG. 1).

The upper actuator member 170 is integrally formed from a single piece of polymeric material. Similarly, the lower actuator member 172 is integrally formed from a single piece of polymeric material. The bearing sections 182 and 184 on the upper actuator member 170 are formed by rolling the polymeric material forming the upper actuator member. Similarly, the bearing sections 200 and 202 on the lower actuator member 172 are formed by rolling the polymeric material of the lower actuator member.

By forming each of the actuator members 170 and 172 as a single piece of polymeric material, the number of components of the switch assembly 10 is minimized. In addition, by forming the upper and lower actuator members 170 and 172 polymeric material, the weight of the switch assembly 10 tends to be minimized.

The bearing sections 182 and 184 are pivotally mounted on the inner housing 136 at a location adjacent to a left (as viewed in FIG. 1) wall of the housing 12. Similarly, the bearing sections 200 and 202 on the lower actuator member 172 are pivotally mounted on the inner housing 136 adjacent to a right wall of the outer housing 12 (FIG. 1). The bearing sections 182 and 184 on the upper actuator member 170 are received in a pair of parallel spaced apart slots formed by the side walls of the inner housing 136. Similarly, the bearing sections 200 and 202 on the lower actuator member 172 are received in a pair of slots in the side walls of the inner housing 136. Therefore, the upper and lower actuator members 170 and 172 are pivotally mounted without providing separate axles or pivot pins to support the upper and lower actuator members.

The lower force transmitting pin 82 of the force transmitting apparatus 26 extends downward (as viewed in FIG. 1) into engagement with the main section 188 of the upper actuator member 170. At this time, the switch assembly 10 is in the unactuated condition. The coil spring 176 is effective to urge the upper actuator member 170 to pivot in a counter clockwise direction (as viewed in FIG. 1). This results in the upper actuator member 170 being pressed against the lower force transmitting pin 182.

The coil spring 176 applies force to the lower actuator member 172. When the switch assembly 10 is in the unactuated condition, the coil spring 176 urges the lower actuator member 172 to pivot in a counterclockwise direction (as viewed in FIG. 1) relative to the inner housing 136. The lower actuator member 172 has side projections 236 and 238 (FIG. 8) which engage stop surfaces (not shown) on the inner housing 136 to limit pivotal movement of the lower actuator member.

When the lower actuator member 172 is in the unactuated position of FIG. 1, the projections 236 and 238 engage lower stop surfaces on the inner housing 136. When the lower actuator member 172 is in the actuated position of FIG. 4, the projections 236 and 238 engage upper stop surfaces on the inner housing. The upper and lower stop surfaces may be formed by opposite side surfaces which at least partially form openings in the inner housing 136.

When the push button 24 is actuated, force is transmitted from the push button to the force transmitting apparatus 26. This force is applied to the upper actuator member 170 by the force transmitting apparatus. The force applied to the upper actuator member 170 is effective to pivot the upper actuator member in a clockwise direction (as viewed in FIG. 1) against the influence of the helical biasing spring 176.

As the upper actuator member 170 pivots in a clockwise direction from the position shown in FIG. 1, the cross portion 192 on the upper actuator member 170 (FIG. 8) moves into the opening 218 in the lower actuator member 172. At this time, the lower actuator member 172 is still in the unactuated position illustrated in FIG. 1.

The next increment of downward movement of the push button 24 and lower force transmitting pin 182 moves the cross portion 192 on the upper actuator member 170 through the opening 218 in the lower actuator member 172. As this occurs, the biasing spring 176 moves to an overcenter condition and is effective to urge the connector section 214 of the lower actuator member 172 to pivot in a clockwise direction about the bearing sections 200 and 202. This results in the lower actuator member 172 moving quickly, with a snap action, from the unactuated position illustrated in FIG. 1 to the actuated position illustrated in FIG. 3.

As the lower actuator member 172 moves from the unactuated position of FIG. 1 to the actuated position of FIG. 2 with a snap action, the L-shaped connector member 18 is moved upward from the position shown in FIG. 1 to the position shown in FIG. 2. This upward movement of the L-shaped connector member 18 is effective to operate the array 14 of switch contacts with a snap action in the manner previously explained.

When the switch assembly 10 is in the actuated condition (FIG. 1), the biasing spring 176 causes the main section 188 of the upper actuator member 170 to apply force against the lower end of the lower force transmitting pin 82. This force urges the force transmitting apparatus 26 and push button 24 upward (as viewed in FIG. 1). When the push button 24 is manually released, the biasing spring 176 moves the force transmitting apparatus 26 and push button upward. This upward movement causes the end portion 154 of the cam follower 122 to engage the cusp in the cam track 112 (FIG. 3). Force transmitted between the cam block 78 and support pin 130 (FIG. 7) through the cam follower 122 holds the force transmitting apparatus 26 and push button 24 in the latched condition of FIG. 3.

When the push button 24 is again manually actuated, the push button and force transmitting apparatus 26 move downward. This results in the end portion 154 of the cam follower arm 152 (FIG. 7) moving out of engagement with the cusp of the cam track 112.

When the push button 24 is subsequently release for a second time, the force transmitted from the biasing spring 176 through the upper actuator member 170 to the force transmitting apparatus 26 is again effective to move the force transmitting apparatus 26 and push button 24 upward. As this occurs, the upper actuator member 170 pivots in a counter clockwise direction (as viewed in FIG. 4) about the bearing 182 and 184. As the cross portion 192 (FIG. 8) on the upper actuator member 170 moves upward and through the opening 218 in the lower actuator member 172, the helical coil biasing spring 176 again moves through an overcenter condition. This causes the lower actuator member 172 to quickly pivot, in a counter clockwise direction, from the actuated position shown in FIG. 4 to the unactuated position shown in FIG. 1.

As the lower actuator member 172 moves from the actuated position (FIG. 4) to the unactuated position (FIG. 1), the L-Shaped connector member 18 is quickly moved downward from the raised position of FIG. 4 to the lowered position of FIG. 1. This effects operation of the switch contacts 14 from the actuated condition to the unactuated condition with a snap action.

Printed Circuit

A printed circuit 250 (FIG. 9) extends between terminals 252 in the array 22 of switch terminals and the push button 24 (FIG. 1). The push button 24 includes a display which is illuminated by a plurality of solid state light sources. The solid state light sources are energized by electrical energy conducted through the printed circuit 250 to illuminate the display. The display in the push button 24 may have a construction similar to the construction disclosed in U.S. Pat. Nos. 5,295,050; 5,544,019; 5,659,297; 5,820,246; 5,913,617; 5,951,150; and/or 6,153,841. It should be understood that the specific construction of the display utilized in association with the push button 24 will depend upon the environment in which the switch assembly 10 is to be utilized.

The printed circuit 250 (FIG. 9) includes a main section 258 which extends between the push button 24 and the base 62 of the switch assembly 10. The main section 258 of the printed circuit 250 includes a pair of arm sections 262 and 264. The main section 258 has a lower (as viewed in FIG. 9) end portion 268. Electrical conductors in the lower end portion 268 are connected with the terminals 252 and the array 14 of switch contacts.

The main section 258 of the printed circuit 250 includes an upper (as viewed in FIG. 9) end portion 270. The upper end portion 270 is connected with solid state light sources in the display in the push button 24 in a known manner. The solid state light sources in the display in the push button 24 are connected with the terminals 252 and the lower end portion 268 of the printed circuit 250 by electrical conductors which extend from the upper end portion 270 through an intermediate portion 274 of the main section 258 of the printed circuit 250.

A flexible zig-zag portion 276 of the main section 258 extends between the upper end portion 270 and the intermediate portion 274 of the main section of the printed circuit. Electrical conductors in legs 280 and 282 of the zig-zag portion 276 connect the upper end portion 270 with the intermediate portion 274 of the printed circuit 250. The flexible zig-zag portion 276 of the main section 258 of the printed circuit 250 enables the push button 24 and upper end portion 270 to easily move relative to the intermediate portion 274 of the printed circuit 250 during movement of the push button 24 relative to the housing 12.

The arm sections 262 and 264 of the printed circuit 250 (FIG. 9) are mirror images of each other and have the same general construction and configuration. Thus, the arm sections 262 and 264 include side portions 286 and 288 which extend parallel to each other and perpendicular to the intermediate portion 274 of the main section 258 of the printed circuit 250. In addition, the arm sections 262 and 264 include front flaps 290 and 292 which extend parallel to the intermediate portion 274 of the main section 258 and perpendicular to the side portions 286 and 288 of the arm sections. The front flaps 290 and 292 are electrically connected with the intermediate portion 274 of the main section 258 of the printed circuit 250 by electrical conductors which extend from the front flaps through the side portions 286 and 288 to the intermediate portion 274.

A generally rectangular metal housing 12 has a flat rectangular front wall 300 (FIG. 1) which extends parallel to a flat rectangular rear wall 302. In addition, the housing 12 has flat rectangular parallel side walls 304 and 306 (FIG. 2) which extend perpendicular to the front and rear walls 300 and 302. The housing 12 is formed from a single piece of metal. Of course, the housing 12 may be formed of a plurality of pieces of metal. A layer of heat conductive material (not shown) may be provided between the printed circuit 250 and the housing 12. The layer of heat conductive material may be a tape which is secured to the printed circuit by adhesive.

Figure 9:
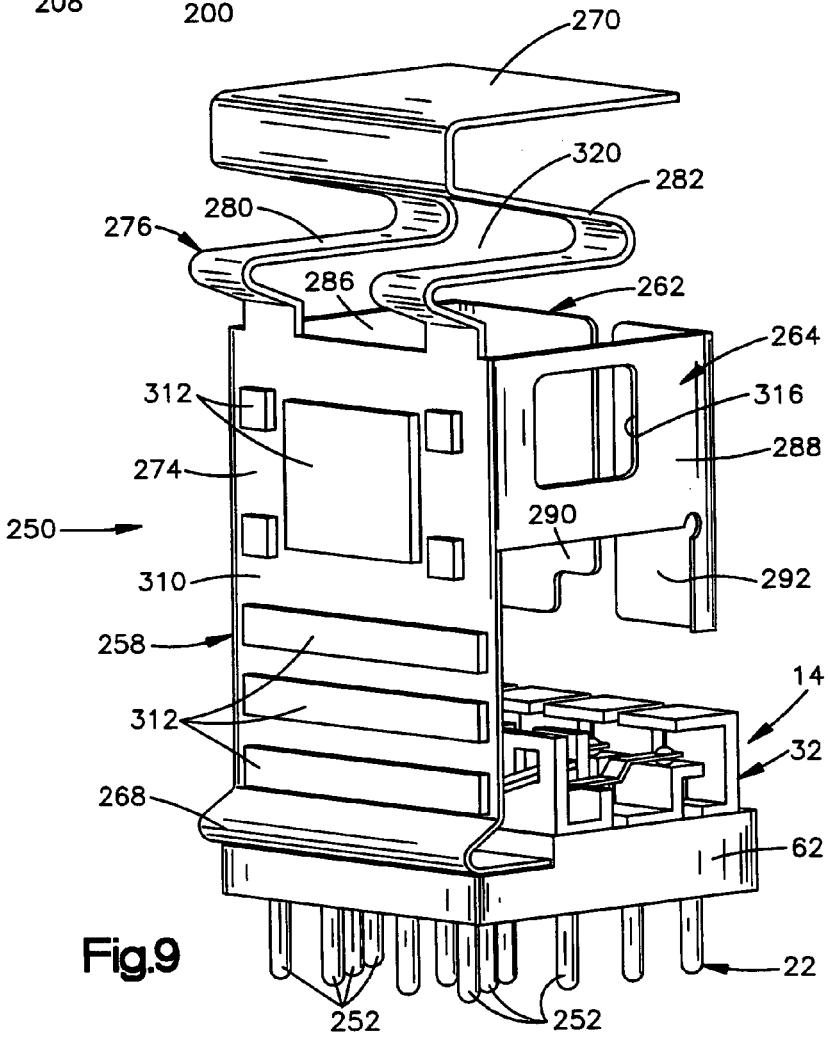
FIG. 9. is a simplified schematic pictorial illustration depicting a printed circuit and electronic circuitry utilized in the switch assembly of FIGS. 1–4.

The main section 58 of the printed circuit 250 is a flat rectangular outer side surface 310 which faces toward the rear wall 302 and is spaced a slight distance from the rear wall (FIG. 1). Electrical circuit components, indicated schematically at 312 in FIG. 9, are disposed on the outer side surface 310 of the intermediate portion 274 of the printed circuit 250. The electrical circuit components 312 are disposed adjacent to the rear wall 302 of the housing 12 to facilitate heat transfer from the electrical circuit components to the metal rear wall of the housing.

Similarly, the front flaps 290 and 292 (FIG. 9) are disposed adjacent to the front wall 300 (FIG. 1) of the housing 12. Electrical circuit components are mounted on the sides of the front flaps 290 and 292 facing toward the front wall 300. The electrical circuit components on the front flaps 290 and 292 are disposed in close proximity to the front wall 300 of the housing 12 to promote heat transfer from these electrical circuit components to the metal front wall of the housing.

In the illustrated embodiment of the printed circuit 250, there are no electrical circuit components disposed on the side portions 286 and 288 of the printed circuit. However, electrical circuit components may be disposed on the side portions 286 and 288 of the printed circuit if desired.

A layer of heat conductive material (not shown) is provided between the printed circuit 250 and the container 12. The layer of heat conductive material overlies electrical circuit components 312 on the main section 258 and arm sections 262 and 264 of the printed circuit 250. The layer of heat conductive material protects the electrical circuit components 312 during insertion of the printed circuit 250 into the container 12. The layer of heat conductive material may be a tape formed of material having a high rate of heat conductivity, such as metal, and secured to the electrical circuit components by adhesive.

Since the electrical circuit components 312 are mounted on the printed circuit 250, any one of a plurality of different electrical circuit components may be mounted on the printed circuit. This enables postponement of a decision as to which electrical circuit components 312 are to be used with a particular switch assembly 10. Therefore, the switch assembly 10 may be easily customized shortly before it is to be supplied to a user of the switch assembly.

A rectangular opening 316 is provided in the side portion 288. A similar rectangular opening (not shown) is formed in the side portion 286 of the printed circuit. The openings in the side portions 286 and 288 of the printed circuit enable connectors to extend between the inner housing 136 (FIG. 1) and the housing 12 through the side portions of the printed circuit. Of course, the openings 316 in the side portions 286 and 288 of the printed circuit 250 may be omitted. This would facilitate the mounting of electrical circuit components on the side portions 286 and 288 of the printed circuit.

The zig-zag portion 276 of the printed circuit 250 forms an openings 320 between the legs 280 and 282. The upper force transmitting pin 80 (FIG. 5) extends through the opening 320 (FIG. 9) into engagement with the push button 24.

Indicator Assembly

Figure 10:
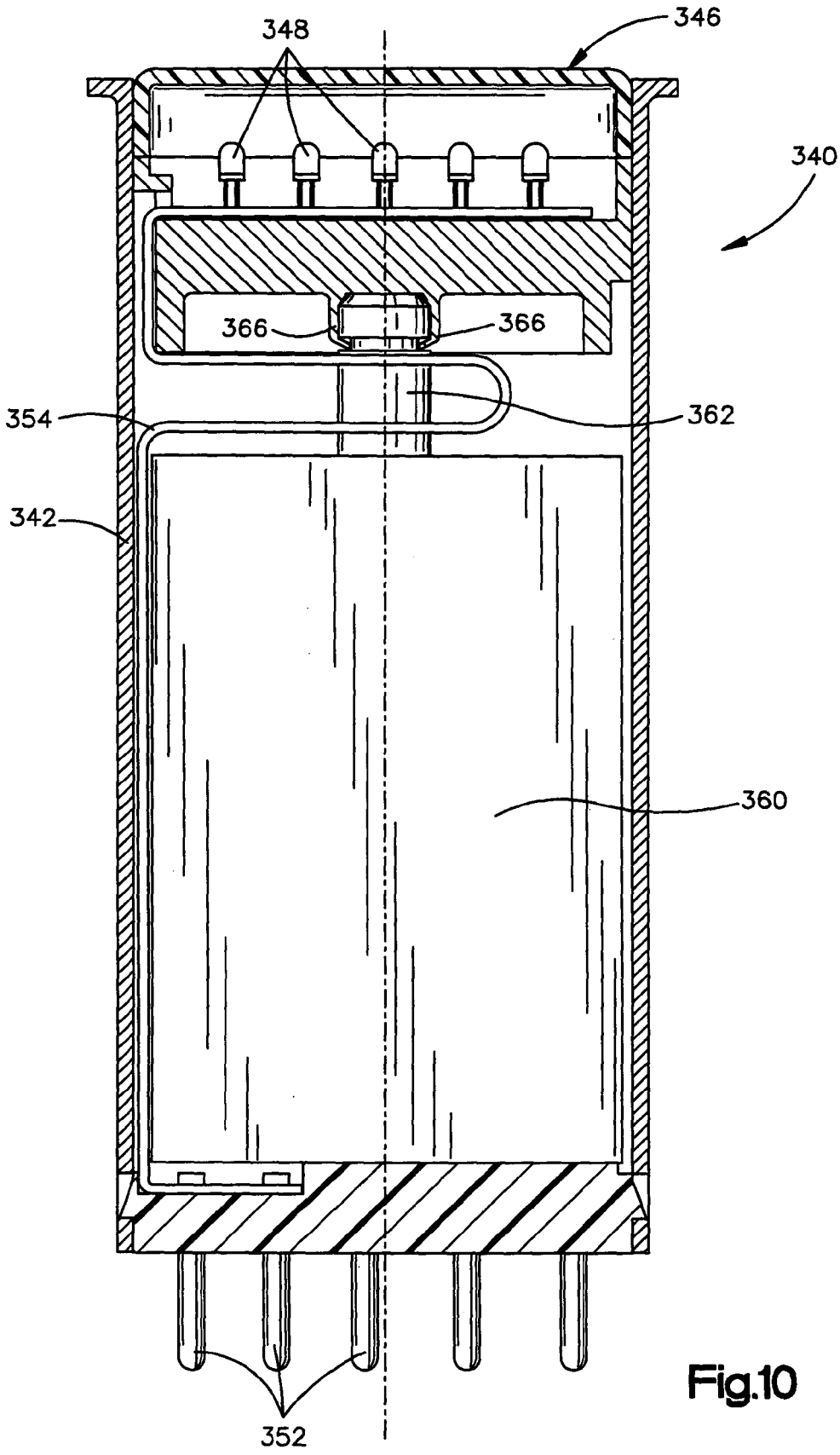
FIG. 10. is a simplified schematic sectional view illustrating the construction of an indicator apparatus.

An indicator assembly 340 (FIG. 10) has the same overall size and configuration as the switch assembly 10. The indicator assembly 340 includes a rectangular metal housing 342. The rectangular metal housing 342 has the same construction and size as the metal housing 12 of the switch assembly 10. This enables the housing 342 of the indicator assembly 340 to be installed in the same space as in which the switch assembly 10 is installed.

The indicator assembly 340 may be substituted for the switch assembly 10. Alternatively, the switch assembly 10 may be substituted for the indicator assembly 340. This enables a single opening or installation location in a control panel to receive either the indicator assembly 340 (FIG. 10) or the switch assembly 10 (FIG. 1).

The indicator assembly 340 includes a display 346. The display 346 includes a plurality of solid state light sources 348 which are energizable by electrical energy conducted from terminals 352 to the display 346 through a printed circuit 354. The printed circuit 354 may have a construction similar to the construction of the printed circuit 350 of FIG. 9. However, the arm sections 262 and 264 may be omitted from the printed circuit 354 if desired.

A rectangular spacer block 360 is connected with the terminals 352. The rectangular spacer block 360 is connected with the display 346 by a cylindrical support member 362. The cylindrical support member 362 is connected with the display 360 in the same manner as in which the upper force transmitting pin 380 (FIG. 5) is connected with the push button 24. Thus, a plurality of flanges 366 engage an annular groove in the support member 362 in the same manner as in which the flanges 104 (FIG. 6) engage the annular groove 96 in the upper force transmitting pin 80. The flanges 366 which connect the support member 362 with the display 346 provide a snap connection which can be readily established during installation of the indicator assembly 340 and readily disconnected for disassembly of the indicator assembly.

Conclusion

In view of the foregoing description, it is apparent that the present invention provides an improved switch assembly 10 which is relatively light in weight and has relatively few component parts. The switch assembly 10 may include switch contacts 14 which are at least partially disposed in a housing 12 and are operable between actuated and unactuated conditions (FIGS. 1 and 4). A switch actuation mechanism 16 may be disposed in the housing 12 and connected with the switch contacts 14. A force transmitting apparatus 26 may extend between a push button 24 and the switch actuation mechanism 16 to transmit force from the push button to the switch actuation mechanism. The switch actuation mechanism 16 may be of the snap action type.

The force transmitting apparatus 26 may include a cam block 78. First and second force transmitting pins 80 and 82 may be integrally formed as one piece with the cam block 78. A cam follower 122 may engage a cam surface 114 and/or 116 on the cam block 78 to retain the switch contacts 14 in an actuated condition.

The switch actuation mechanism 16 may include a plurality of actuator members 170 and 172. Each of the actuator members 170 and 172 may include a main section 188, 208 and a plurality of bearing sections 182, 184, 200, and 202. The main section and bearing sections of each actuator member may be integrally formed as one piece.

The push button 24 may have an opening 98 into which an end portion 92 of one of the force transmitting pins 80 extends. A resiliently deflectable flange 104 may engage a groove 96 in the end portion 92 of the force transmitting pin 80. The flange 104 on the push button 24 interconnects the push button 24 and the force transmitting pin 80 so that the force transmitting pin can snap into the opening 98 in the push button.

The push button 24 may advantageously be connected with the switch contacts 14 by a printed circuit 250. Electrical circuit components 312 may be mounted on the printed circuit 250. The printed circuit 250 may have an opening 320 through which the force transmitting pin 80 extends from the cam block 78 to the push button 24.

The present invention has a plurality of different features. These features may advantageously be utilized in combination with each other in the manner disclosed herein. Alternatively, the features may be utilized separately and/or in combination with known features from the prior art. For example, the snap connection between the force transmitting apparatus 26 and push button 24 may be used without forming each of the actuator members 170 and 172 in the snap action mechanism 16 as one piece. As a further example, the one piece force transmitting apparatus 26 may be used without providing a snap connection between the force transmitting apparatus and the push button 24. Although the switch actuation mechanism 16 is advantageously of the snap action type, a different type of switch actuation mechanism may be used if desired.

What is claimed is:

1. An assembly comprising a housing, switch contacts at least partially disposed in said housing and operable between actuated and unactuated conditions, a switch actuation mechanism at least partially disposed in said housing, said switch actuation mechanism being operable between first and second conditions to effect operation of said switch contacts between the actuated and unactuated conditions, a cam follower at least partially disposed in said housing, a cam block having a cam surface with a first portion which is engaged by said cam follower when said switch contacts are in the unactuated condition and a second portion which is engaged by said cam follower when said switch contacts are in the actuated condition, a manually movable push button, a first force transmitting pin extending between said push button and said cam block to transmit force from said push button to said cam block, and a second force transmitting pin extending between said cam block and said switch actuation mechanism to transmit force from said cam block to said switch actuation mechanism, said cam block and said first and second force transmitting pins being integrally formed as one piece.

2. An assembly as set forth in claim 1 wherein said switch actuation mechanism includes a first actuator member, said first actuator member includes a first main section and first and second bearing sections having cylindrical bearing surfaces extending from said first main section to support said first actuator member for pivotal movement relative to said housing about a first axis which is coincident with central axes of said first and second cylindrical bearing surfaces, said first main section and said first and second bearing sections being integrally formed as one piece, a second actuator member, said second actuator member includes a second main section and third and fourth bearing sections having cylindrical bearing surfaces extending from said second main section to support said second actuator member for pivotal movement relative to said housing about a second axis which is coincident with central axes of said third and fourth cylindrical bearing surfaces, said second main section and said third and fourth bearing sections being integrally formed as one piece, and a spring extending between said first and second actuator members, said spring being effective to press said first main section of said first actuator member against said second force transmitting pin, said spring being effective to apply force against said second actuator member to pivot said second actuator member about said second axis during pivotal movement of said first actuator member about said first axis.

3. An assembly as set forth in claim 2 wherein said switch actuation mechanism is a snap action mechanism which effects operation of said switch contacts between the actuated and unactuated conditions with a snap action, said first actuator member being formed by a first piece of polymeric material, said second actuator member being formed by a second piece of polymeric material.

4. An assembly as set forth in claim 1 further including an annular groove in an end portion of said first force transmitting pin and a flange connected with said push button, said flange being disposed in engagement with said groove in said end portion of said first force transmitting pin to interconnect said push button and said first force transmitting pin.

5. An assembly as set forth in claim 1 further including a casing disposed within said housing, said casing including a support pin extending outward from a wall of said casing, said support pin being integrally formed as one piece with said wall of said casing, said cam follower includes a helical coil section which extends around said support pin, a follower arm which extends from said helical coil section into engagement with said cam surface, and a base arm which extends from said helical coil section and engages said casing.

6. An assembly as set forth in claim 5 wherein said follower arm has a main section and an end section which extends perpendicular to said main section of said follower arm and engages said cam surface, said base arm has a main section and an end section which engages said casing, said end section of said follower arm and said end section of said base arm having central axes which extend parallel to a central axis of said support pin.

7. An assembly as set forth in claim 1 wherein said push button includes a plurality of solid state light sources which are electrically energizable to provide illumination, said assembly further includes a printed circuit connected with said switch contacts and said push button, and a plurality of electrical circuit components mounted on said printed circuit at a location between said push button and said switch contacts.

8. An assembly as set forth in claim 7 wherein said first force transmitting pin extends through an opening formed in said printed circuit at a location between said push button and said cam block.

9. An assembly as set forth in claim 7 wherein said printed circuit has a first major side surface which faces toward said housing and a second major side surface which faces away from said housing, at least a portion said electrical circuit components being disposed on said first major side surface of said printed circuit.

10. An assembly as set forth in claim 7 wherein said housing has a plurality of side walls disposed in a rectangular array, said printed circuit includes a main section and first and second arm sections, said main section of said printed circuit having a first end portion disposed adjacent to said switch contacts, a second end portion which is disposed adjacent to said push button and an intermediate portion which extends between said first and second end portions and is disposed along a first side wall of said plurality of side walls of said housing, said first arm section of said printed circuit extends from said main section of said printed circuit and is disposed along second and third side walls of said plurality of side walls, said second arm section of said printed circuit extends from said main section of said printed circuit and is disposed along a fourth side wall of said plurality of side walls and is disposed along said third side wall of said plurality of side walls.

11. An assembly as set forth in claim 10 wherein a first portion of said electrical circuit components are mounted on said intermediate portion of said main section of said printed circuit, a second portion of said electrical circuit components are mounted on said first arm section of said printed circuit, and a third portion of said electrical circuit components are mounted on said second arm section of said printed circuit.

12. An assembly comprising a housing, switch contacts at least partially disposed in said housing and operable between actuated and unactuated conditions, a switch actuation mechanism at least partially disposed in said housing, said switch actuation mechanism being operable between first and second conditions to effect operation of said switch contacts between the actuated and unactuated conditions, a manually movable push button, said manually engagable push button includes a plurality of light sources which are connected with said push button for movement with said push button relative to said housing, a force transmitting apparatus extending between said push button and said switch actuation mechanism to transmit force to said switch actuation mechanism, and a printed circuit connected with said switch contacts and said light sources, said printed circuit includes a flexible portion which is deflected by movement of said push button, said flexible portion of said printed circuit includes an opening through which said force transmitting apparatus extends.

13. An assembly as set forth in claim 12 wherein said force transmitting apparatus includes a first force transmitting pin connected with push button, a second force transmitting pin, and a cam block integrally formed as one piece with said first and second force transmitting pins, said first and second force transmitting pins and said cam block being movable relative to said housing under the influence of force transmitted from said push button to effect operation of said switch actuation mechanism.

* * * * *